US009351626B2

(12) United States Patent
Scolari

(10) Patent No.: US 9,351,626 B2
(45) Date of Patent: May 31, 2016

(54) STEAMER MOP HAVING QUICK CHANGE CLEANING PAD

(71) Applicant: Nathan A. Scolari, Greenville, SC (US)

(72) Inventor: Nathan A. Scolari, Greenville, SC (US)

( * ) Notice: Subject to any disclaimer, the term of this patent is extended or adjusted under 35 U.S.C. 154(b) by 0 days.

(21) Appl. No.: 14/873,762

(22) Filed: Oct. 2, 2015

(65) Prior Publication Data

US 2016/0022111 A1 Jan. 28, 2016

Related U.S. Application Data

(63) Continuation of application No. 14/205,632, filed on Mar. 12, 2014, now Pat. No. 9,173,540.

(60) Provisional application No. 61/790,748, filed on Mar. 15, 2013.

(51) Int. Cl.

| | |
|---|---|
| ***A47L 11/34*** | (2006.01) |
| ***A47L 13/22*** | (2006.01) |
| ***A47L 11/40*** | (2006.01) |
| ***A47L 11/26*** | (2006.01) |

(52) U.S. Cl.

CPC ..... *A47L 13/225* (2013.01); *A47L 11/26* (2013.01); *A47L 11/4011* (2013.01); *A47L 11/4013* (2013.01); *A47L 11/4041* (2013.01); *A47L 11/4047* (2013.01); *A47L 11/4075* (2013.01); *A47L 11/4083* (2013.01); *A47L 11/4086* (2013.01); *A47L 11/4088* (2013.01)

(58) Field of Classification Search

CPC . A47L 13/225; A47L 11/405; A47L 11/4075; A47L 11/4086; A47L 11/408; A47L 9/0686; A47L 5/30; A47L 11/4044; A47L 11/4047; A47L 11/4013

USPC ..... 15/320–322, 314, 354, 403, 97.1, 98, 15/103.5

IPC ..... A47L 11/34

See application file for complete search history.

(56) References Cited

U.S. PATENT DOCUMENTS

| | | | |
|---|---|---|---|
| 2,601,537 | A | 6/1952 | Lofgren |
| 2007/0209139 | A1 | 9/2007 | Carlucci et al. |
| 2010/0287716 | A1 | 11/2010 | Kasper et al. |
| 2014/0245561 | A1 | 9/2014 | Pi et al. |

FOREIGN PATENT DOCUMENTS

| | | | |
|---|---|---|---|
| CN | 20197735 | U | 9/2011 |
| EP | 2465400 | A2 | 6/2012 |

OTHER PUBLICATIONS

International Search Report and Written Opinion of the International Searching Authority for PCT/US2014/027368.

* cited by examiner

*Primary Examiner* — David Redding

(74) *Attorney, Agent, or Firm* — McNair Law Firm, P.A.; Douglas W. Kim

(57) ABSTRACT

The invention relates generally to an improved mop having a support arm having a handle, a mop head that is pivotally attached to said support arm, a pair of rollers disposed in said mop head at lateral side of the mop head housing, a cleaning pad rotatably carried by said rollers so that a first roller carries said cleaning pad and a second roller draws sections of said cleaning pad across a cleaning area defined by said mop head, whereas the cleaning pad travel along a path orthogonal to the front of the housing, a spray nozzle carried by said mop head that is fluidly connected to a cleaning solution container for allowing the user to select and spray a cleaning solution on the surface being cleaned, and an ultra violet light source disposed on said mop head for disinfecting said cleaning pad.

21 Claims, 3 Drawing Sheets

STEAMER MOP HAVING QUICK CHANGE CLEANING PAD

BACKGROUND OF THE INVENTION

1) Field of the Invention

This invention is directed to a steamer mop having an improved cleaning assembly including a cleaning pad that allows for cleaning sections of the cleaning pad to come in contact with the cleaning area. The cleaning sections can be periodically changed so that the unused or clean portion of the cleaning pad contacts the cleaning surface. The cleaning sections can be changed a predetermined number of times before having to remove and/or replace the entire cleaning pad.

2) Description of Related Art

Steamer mops that have the capability of using steam to mop a floor are generally known in the art. The primary disadvantage with these mops is that the consumer is required to change the cleaning pads multiple times during use to ensure that a clean pad is being used. One of the reasons that the cleaning pad must be changed so frequently is that the prior art systems do not include any mechanism that is designed to help clean the cleaning pad in use.

Further, steamer mops traditionally have the disadvantage of dirt that is located on the cleaning pad is actually rubbed into the floor after a certain amount of use of the cleaning pad. As the cleaning pad is used, the efficiency of the pad diminishes. If used too long, based upon the volume of dirt involved, the cleaning pad can actually deposit more dirt to the floor that it removes. Typically, users do not remove and clean the cleaning pad in a sufficient interval to avoid this effect.

Another disadvantage of the prior art is that it does not include any mechanism that may be used to kill bacteria without the need for the use of a cleaning solution. Specifically, the prior art mops do not have any method of killing the bacteria trapped on the cleaning pad while the mop is being used.

While it is known that the prior art steaming mops may include a reservoir that allows a cleaning solution to be sprayed in front of the cleaning pad, the prior art fails to include a mechanism to allow the user to choose between two different types of cleaning solutions that may be sprayed in front of the cleaning pad.

Accordingly, it is an object of the present invention to provide an improved steamer mop that provides a cleaning pad having a plurality of cleaning sections that can automatically engage the floor at a cleaning area during use without the need for manually changing the cleaning pad.

Accordingly, it is an object of the present invention to provide an improved steamer mop that can clean one of said cleaning sections of the cleaning pad after use so that said cleaning section may be reused prior to manually changing the cleaning pad.

Accordingly, it is an object of the present invention to provide an improved steamer mop that uses a U-V light source to kill any bacteria that becomes trapped on the cleaning pad without the use of additional cleaning products.

Accordingly, it is an object of the present invention to provide an improved steamer mop that allows the user to shine a U-V light source on the floor to gauge the cleanliness of the floor.

Accordingly, it is an object of the present invention to provide an improved mop having a reservoir capable of containing two different types of cleaning solutions and allowing the user to select the desired cleaning solution to be sprayed in front of the cleaning pad.

SUMMARY OF THE INVENTION

The invention relates generally to an improved mop having a support arm having a handle, a mop head that is pivotally attached to said support arm, a pair of rollers disposed in said mop head, a cleaning pad rotatably carried by said rollers so that a first roller carries said cleaning pad and a second roller draws sections of said cleaning pad across a cleaning area defined by said mop head, a spray nozzle carried by said mop head that is fluidly connected to a cleaning solution container for allowing the user to select and spray a cleaning solution on the surface being cleaned, and a light source disposed on said mop head for disinfecting said cleaning pad.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail.

Figure 1:
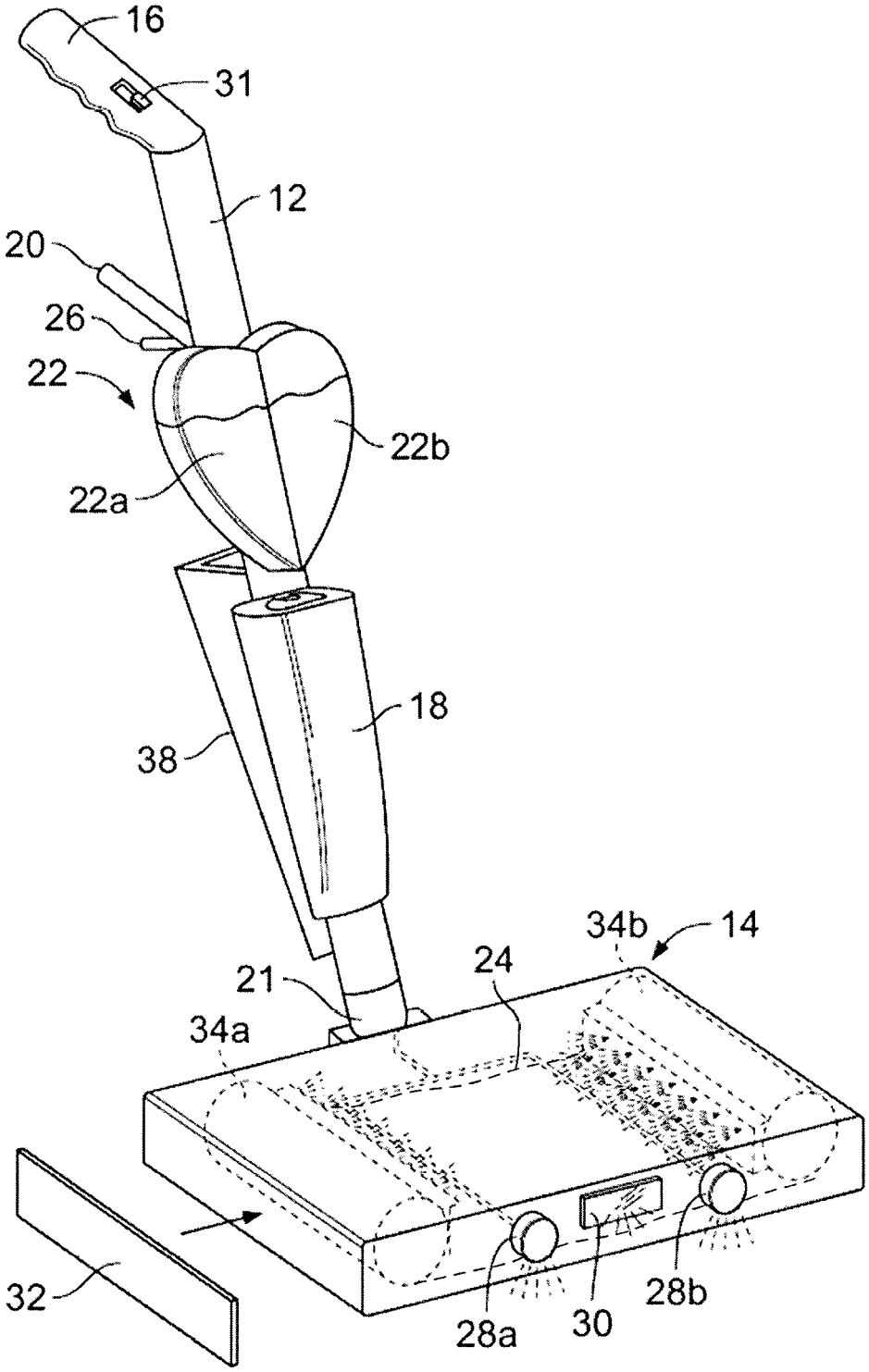
FIG. 1 shows perspective view of aspects of the invention.

FIG. 1 provides a perspective illustration of the improved steamer mop 10. The mop includes a support arm 12 that is pivotally connected to the mop head 14 and includes a handle section 16. The support arm 12 includes a water reservoir 18 that is fluidly connected to a heating element 21 contained in the mop head 14 so that steam may be created by means generally known in the art. The heating elements, and rollers in one embodiment, can be powered through attachment to a power source from a cord or from a battery source on board. In at least one embodiment, the flow of water from the water reservoir to the heating element is controlled by the pump lever 20. In this embodiment, the pump lever 20 can either manually actuate a water pump (not shown) to force the water to flow from the reservoir 18 to the heating element 21 or the pump lever 20 may electrically actuate a water pump (not shown) to force the water to the heating element. In an alternate embodiment, however, the flow of water may be automatically regulated by means of a timer, temperature sensor, moisture sensor or humidity sensor that automatically actuates the water pump once predefined criteria have been sensed by the sensor(s). Once the water reached the heating element, steam is created and directed toward the cleaning pad 24 so as to aid with the cleaning of the floor.

In one embodiment, the support handle 12 further includes a cleaning reservoir 22 where one or more types of cleaners can be stored. In the shown embodiment, the cleaning reservoir includes two cleaning sections 22*a* and 22*b* that can store and separate two different types of cleaning solutions. In one embodiment, the handle section 16 includes a three way switch 26 that allows the user to select between water, a first cleaning solution and a second cleaning solution so that when pump lever is engaged, the selected fluid is directed towards the mop head. If water is selected, it is directed towards the heating element where it is then heated until steam is created and directed towards the cleaning pad 24. If, however, one of the two cleaning solutions is selected, the solution is directed down the support shaft 12 to one or both of the spray nozzles 28*a* and 28*b* so that the cleaning solution can be sprayed in front of the cleaning pad 24. If, however, the water flow is controlled by one or more sensors, the three way switch may be replaced with a two way switch that allows the user to select the appropriate cleaning solution to be dispensed from the cleaning reservoir 22.

In one embodiment, the mop is provided with an ultraviolet light source 30 on the front of the mop head 14 so that the user can shine the ultraviolet light source on the surface being cleaned to determine if the surface is sufficiently clean. While the shown embodiment shows a single light source on the front of the mop head 14, multiple light sources could be positioned around the entire periphery of the mop head. Alternately, a single light source could extend around the periphery of the mop head. This ultraviolet light source can be activated by button 31 that is located on handle 16.

In one embodiment, the mop head could include cleaning pads 32 on the sides of the mop head 14 so that when the mop head contacts a baseboard or the like, the cleaning pad 32 will collect any dirt that may be on the baseboard. These cleaning pads could be made of any suitable material including cloth or tacky paper or any other material generally known in the art.

Figure 2:
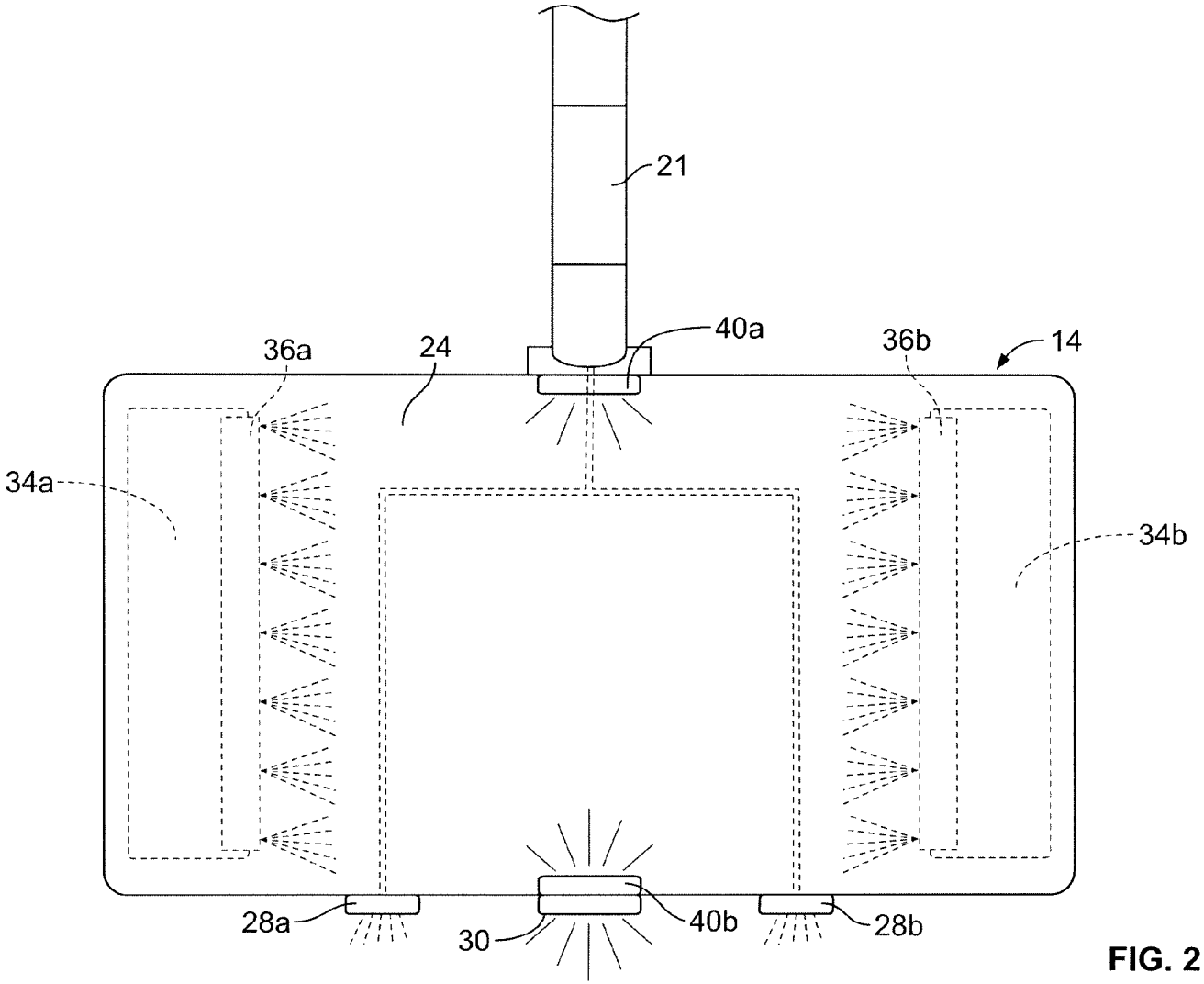
FIG. 2 shows a top plan view of the mop head.

Referring now to FIGS. 1-2, the cleaning pad changing system can be more clearly seen. Mop head 14 includes two rollers 34*a* and 34*b*. These rollers can be electrical or manually rotated. In one embodiment, the first roller or feed roller 34*a* carries the cleaning pad 24 while the second roller or take up roller 34*b* draws the cleaning pad 24 across the mop head so that different sections of the cleaning pad can be used during cleaning once the previous section used becomes dirty. Thus, the user is allowed to use several sections of the cleaning pad 24 before the cleaning pad must ultimately be changed and/or cleaned. Cleaning pad 24 can be made of any suitable material generally known in the art, including disposable materials and/or materials that can be washed and reused.

In one embodiment, a first cleaning pad is carried by the first roller and rotates to provide for a cleaning section to come in contact with a cleaning area. As the roller rotates, a unused cleaning section is moved into place to contact the cleaning area. The second cleaning pad can be carried by the second roller and rotates to provide for a cleaning section to come in contact with a cleaning area. Again, the second roller rotates, an unused cleaning section is moved into place to contact the cleaning area.

In one embodiment, the mop head 14 further includes a pair of brushes 36*a* and 36*b* that are disposed generally adjacent to the rollers 34*a* and 34*b*. These brushes help remove any excess dirt from the cleaning pad as it is being wrapped around the rollers and as the cleaning section of the cleaning pad is being drawn across the cleaning surface. In one embodiment, the brushes are spring biased so that the brushes remain in contact with the cleaning pad as it is being drawn from one roller to the other. In at least one embodiment, the mop head is provided with a dirt collection tray disposed beneath the brushes. In another embodiment, the mop head is provided with a vacuum that will suck the excess dirt into a dirt storage bin 38 disposed on support arm 12.

If the user desires, the user can reuse the cleaning pad 24 once the cleaning pad has been drawn from the first roller 24*a* to the second roller. Since the brushes remove the excess dirt from the cleaning pad, several sections can be reused by drawing the cleaning pad from the second roller 34*b* back to the first roller 34*a*. The rollers can be activated using a button or switch that when activated causes the rollers to draw the cleaning pad across the cleaning surface in the desired direction. In an alternate embodiment, the rollers could be controlled by a timer or appropriate sensor so that the user does not have to activate the rollers.

Figure 3:
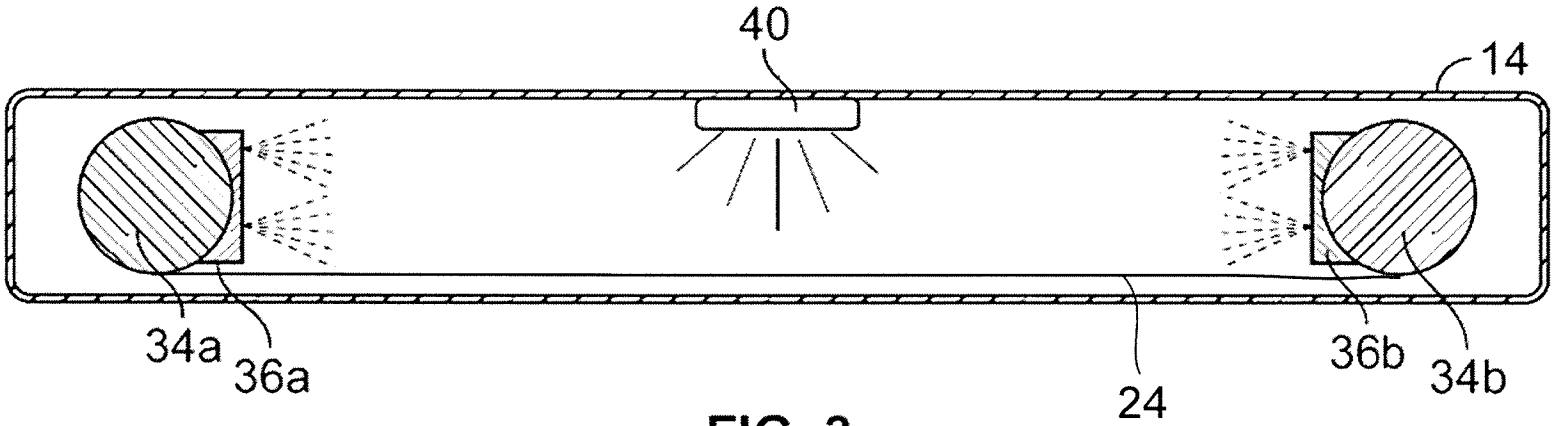
FIG. 3 shows a cross section view of mop head.

In one embodiment, the mop is provided with one or more UV light sources 40*a* and 40*b* disposed in the mop head that direct UV light towards the cleaning pad. This helps disinfect the cleaning pad from any bacteria that may have been collected by the cleaning pad. As shown in FIGS. 2-3, this light source 30 or sources 40*a* and 40*b* may be disposed on the sides of the mop head or the top of the mop head so that it shines directly down at the cleaning pad.

Once the cleaning pad requires cleaning or replacement, a section of the mop head may be removed so that the mop head may be removed and/or replaced. In one embodiment, the cleaning pad and the rollers are removed together. In alternate embodiments, only the cleaning pad is removed. In one embodiment, the cleaning pad is attached to the rollers by way of Velcro® but any other methods, such as clips, ties, snaps, or buttons can be used. In an alternate embodiment, the cleaning pad is disposed on two cores of suitable material, which may then slide over the rollers.

While the shown embodiment is rectangular, the mop head 14 could be any shape that is generally known.

While a preferred embodiment of the invention has been described using specific terms, such description is for illustrative purposes only, and it is to be understood that changes and variations may be made without departing from the spirit or scope of the following claims.

What is claimed is:

1. A steam mop comprising:

a mop head including an housing attached to a support arm;

a feed roller disposed within the housing attached at an internal lateral side of the housing;

a cleaning pad removably attached to the feed roller;

a take up roller for receiving the cleaning pad as it travels along a path orthogonal to a front of the mop head so that an edge of the cleaning pad faces forward relative to the housing wherein the cleaning pad travels from the feed roller to the take up roller so that a used cleaning section of the cleaning pad is transferred to the take up roller and an unused cleaning section of the cleaning pad is fed from the feed roller for contact with a cleaning area whereas the take roller is disposed in the housing attached at an opposite internal lateral side relative to the feed roller;

a brush carried by the mop head, disposed adjacent to the take up roller and in contact with the cleaning pad so as to remove debris from the cleaning pad as the cleaning pad is transferred to the take up roller;

a dirt collection tray disposed beneath the brush to receive debris removed from the take up roller by the brush;

a water reservoir carried by the support arm and in fluid communication with a cleaning reservoir so that cleaning fluid contained in the cleaning reservoir can be mixed with water contained in the water reservoir and delivered to a spray nozzle attached to the mop head and in fluid communication with the water reservoir for spraying that water and cleaner mixture onto a cleaning area;

a vacuum assembly carried by the support arm for drawing dirt removed from the cleaning pads by the brushes that is deposited in a dirt collection tray included in the mop head into a dirt storage bin carried by the support arm; and, an ultra violet light carried by the mop head for projecting ultraviolet light.

2. The mop of claim 1 including a second brush adjacent to the feed roller to remove debris from the cleaning pad when the cleaning pad direction is reversed and travels from the take up roller to the feed roller.

3. The mop of claim 1 wherein the cleaning reservoir is carried by the support arm and is in fluid communication with the water reservoir and includes two compartments containing two differing cleaning fluids and a three way switch to select between a first container, a second container and both containers so that the cleaner mixture can be varied according to the setting of the three way switch.

4. The mop of claim 1 including a heater carried by the support arm for heating the water into steam that can be directed to the cleaning area by the spray nozzle.

5. The mop of claim 1 including a pump handle to actuate a pump for forcing water from the water reservoir to a heater and out through the spray nozzle.

6. The mop of claim 1 including a second ultraviolet light carried by the mop head for projecting ultraviolet light onto the cleaning pad to reduce or eliminate microorganisms from the cleaning pad prior to the used portion of the cleaning pad being taken up by the take up roller.

7. The mop of claim 1 including a side cleaning pad attached to the side of the mop head for cleaning vertical surfaces.

8. A steam mop comprising:

a mop head including a housing attached to a support arm and a handle;

a feed roller disposed within the housing and positioned at a lateral side of the housing;

a take up roller disposed within the housing and position at an opposite lateral side of the housing relative to the feed roller;

a first cleaning pad attached to the feed roller and a second cleaning pad attached to the take up roller so that when the rollers rotate, the cleaning pad travel along a path from the lateral side of the housing to an opposite lateral side of the housing so that an unused cleaning section of the cleaning pad contacts a cleaning area and a forward edge of the cleaning pad is disposed forward relative to the handle and parallel to a front of the housing; and, a pair of brushes carried by the mop head, disposed adjacent to the feed roller and the take up roller and in contact with the cleaning pads so as to remove debris from the cleaning pad as the cleaning pad travels from the feed roller to the take up roller.

9. The mop of claim 8 including a water reservoir carried by the support arm and in fluid communication with a cleaning reservoir so that cleaning fluid contained in the cleaning reservoir can be mixed with water contained in the water reservoir and delivered to a spray nozzle attached to the mop head and in fluid communication with the water reservoir for spraying that water and cleaner mixture onto the cleaning area.

10. The mop of claim 9 wherein the cleaning reservoir includes two compartments containing two differing cleaning fluids and a three way switch to select between a first container, a second container and both containers so that the cleaner mixture can be varied according to the setting of the three way switch.

11. The mop of claim 8 including an ultraviolet light carried by the mop head for projecting ultraviolet light.

12. The mop of claim 8 including a plurality of ultraviolet lights disposed within the mop head for reducing or removing microorganisms from the cleaning pads as the cleaning pads travel around the rollers.

13. The mop of claim 8 including a side cleaning pad attached to the side of the mop head for cleaning vertical surfaces.

14. The mop of claim 8 including an ultraviolet light attached to the mop head for projecting ultra violet light onto the cleaning area.

15. A steam mop comprising:

a support arm attached to a housing;

a mop head having a housing, handle, water reservoir and dual chambered cleaning reservoir;

a set of rollers disposed within the housing with a cleaning pad removably attached to at least one roller so that a first cleaning portion of the cleaning pad can contact a cleaning surface and once used, the roller rotates so that a second cleaning portion of the cleaning pad can contact the cleaning area wherein the cleaning pad includes an edge positioned at the front of the housing and parallel to the front of the housing; and, a pump carried by the support arm for forcing water from the water reservoir to a spray nozzle in fluid communication with the water reservoir to apply water to the cleaning area.

16. The mop of claim 15 including a switch, that when activated, causes the rollers to draw the cleaning pad across the cleaning surface.

17. The mop of claim 15 including a timer configured to causes the rollers to draw the cleaning pad across the cleaning surface at predetermined intervals.

18. The mop of claim 15 including a vacuum assembly carried by the support arm for drawing dirt removed from the cleaning pads by the brushes that is deposited in a dirt collection tray included in the mop head into a dirt storage bin carried by the support arm.

19. The mop of claim 15 including wherein the cleaning pad is removable attached to the rollers.

20. The mop of claim 19 including wherein the cleaning pad is washable and replaceable on the rollers.

21. The mop of claim 15 wherein the flow of water is automatically regulated by means taken from the group consisting of: a timer, a temperature sensor, a humidity sensor, a moisture sensor or any combination of these.

* * * * *